US010744635B1

(12) United States Patent
Stratton

(10) Patent No.: US 10,744,635 B1
(45) Date of Patent: Aug. 18, 2020

(54) ELONGATED HAND TOOL, WITH END POINTS, TO ACTUATE OUT OF REACH DEVICE

(71) Applicant: William Loren Stratton, Pleasant Hill, CA (US)

(72) Inventor: William Loren Stratton, Pleasant Hill, CA (US)

( * ) Notice: Subject to any disclaimer, the term of this patent is extended or adjusted under 35 U.S.C. 154(b) by 0 days.

(21) Appl. No.: 16/560,754

(22) Filed: Sep. 4, 2019

(51) Int. Cl.
*A47F 13/06* (2006.01)
*B25G 1/04* (2006.01)
*G08B 29/14* (2006.01)

(52) U.S. Cl.
CPC ..... *B25G 1/04* (2013.01); *A47F 13/06* (2013.01); *G08B 29/145* (2013.01)

(58) Field of Classification Search
CPC .. A47F 13/06; B25G 1/04; B25G 3/14; B66F 19/00; B25F 1/02
USPC ..... 81/489
See application file for complete search history.

(56) References Cited

U.S. PATENT DOCUMENTS 2,980,456 A * 4/1961 McMullin ..... F16B 7/105 403/328
4,422,682 A * 12/1983 O'Connell ..... G08B 29/145 294/209
5,490,825 A * 2/1996 Wilkinson ..... A45B 3/00 482/109
5,799,996 A * 9/1998 Fredrickson ..... A01B 1/20 172/375
6,450,557 B1 * 9/2002 Martinez ..... A47F 13/06 294/210
6,460,910 B2 * 10/2002 Prass ..... B25F 1/00 200/331
D482,113 S * 11/2003 Jones ..... D23/411
6,652,013 B1 * 11/2003 Peterson ..... B25G 1/04 294/210
8,220,852 B2 * 7/2012 Fenstemaker ..... B25F 1/02 294/51
9,422,143 B1 * 8/2016 Truscott ..... B25G 1/04
9,724,593 B2 * 8/2017 Sandusky ..... A63C 17/0013
2017/0057074 A1 * 3/2017 D'Avignon ..... B25F 1/02

FOREIGN PATENT DOCUMENTS

GB 2298492 A * 9/1996 ..... G08B 29/145
GB 2478295 A * 9/2011 ..... G08B 17/10

* cited by examiner

*Primary Examiner* — Joshua T Kennedy

(57) ABSTRACT

In most homes and other buildings, on ceiling or wall near ceiling are alarm and detectors. A person can push their button with subject tool. The subject includes distinctly-shaped attachments, of the same plastic, all of four types and joining methods. First type, body of 2.16 cm (0.85") diameter, hollow black plastic piping, proximal looped cap for hanging, and distal inside threading for joining second or third types. Second type, two extensions of same body features, and a proximal connector instead of cap for joining first and second types. Third type, five attachments of two segments, proximal threaded portion for joining first or second types, and purposefully distinctly-shaped portion for different alarm or detector situations. Fourth type, twenty-one other attachments of said segments, the five shapes with either solid, hollow, or screw (fourth joining method) threaded portion for joining either distal hollow or projected part respectively on further-reaching pole.

5 Claims, 1 Drawing Sheet

ELONGATED HAND TOOL, WITH END POINTS, TO ACTUATE OUT OF REACH DEVICE

INTRODUCTION

This article of manufacture Application concerns the following Subject Items an elongated hand Tool with attachable Extensions and distal end Points. Their common Subject Purpose is to depress or depress and hold a few seconds a Button. The Button is on certain kinds of out of reach Devices located on a ceiling or an upper wall within inches of the ceiling. The kinds of Subject Devices include fire Alarms and smoke, gas or heat Detectors. There are at least two dozen Button shapes and sizes with different locational aspects on the Devices. The Points are distinctly-shaped for the different uses, Device Situations, and Button shapes, sizes, and locational aspects. Some Points are modified for use on a commercial available tool of another kind with further reach.

BACKGROUND

In the U.S. in 2014, there were 134 million residential units of which 93% had one to ten Alarm and/or Detector Devices. They also are in other types of housing units as well as in non-housing buildings. The Devices are actuated in either Emergency situations or for manufacturer recommended regular weekly or at least monthly Testing. In the Emergency situations, the resident may climb on a chair, with the possibility of falling and injury or grab any available elongated object, such as a clothes hanger or broom stick, to push the Button on the 85 dbl screeching Alarm or Detector. Note that a finger, able to reach the Button on the Device, could depress the Button to stop the screeching or to do regular testing to see if the Device's battery is charged or otherwise functional. Most people can not reach these locations, therefore an elongate hand Tool is needed.

PRIOR ART

The following is a tabulation of the five prior art that presently appear relevant:

U.S. Patents

| Pat. No. | Kind Code | Issue Date | Patentee |
|---|---|---|---|
| 1. 9,422,143 | B1 | Aug. 23, 2016 | James Truscott |
| 2. 6,460,910 | B2 | Oct. 8, 2002 | Jeffrey George Prass |
| 3. 4,422,682 | A | Dec. 27, 1983 | Thomas P. O'Connell |

Foreign Patent Documents

| Foreign Doc. Nr. | Cntry. Code | Kind Code | Pub. Date | Patentee |
|---|---|---|---|---|
| 4. 2478295 | GB | A | Sep. 7, 2011 | Farhad Zarrinde |
| 5. 2298492 | GB | A | Sep. 4, 1996 | Douglas Frank Lane |

Patent 1. U.S. Pat. No. 9,422,143 (2016) to Truscott is the only commercially available product.

The patent utility searches of hand tools and related were narrowed to the primary Purpose of to actuate out of reach Devices by depressing the Button on an Alarm or Detector. While 100's of patents of interest were found, and 57 were reviewed in greater detail, only the five were considered fully relevant, though some of these had other related functions.

Here are some generalized design and use issues to be considered when commenting on the five, they may be considered problems or disadvantages and solutions or advantages: a. reach and telescoping assembly; b. ease and effectiveness of use; c. visibility issues; d. point of contact issues; e. materials and making of, and f. costs.

Here are shortened patent descriptions of the five. Each is followed by considered problems or disadvantages. The solutions or advantages of each are generally stated within the descriptions. In the following Advantages section, the disadvantages of the cited Prior Art are lettered and compared to the numbered advantages of the Subject Items.

1. U.S. Pat. No. 9,422,143 (2016) to Truscott: "Handheld extendable tool with rotatable tip to fit smoke detector button".

The 15.23 cm (6") cylindrical metal handle, with plastic cover, has 14 inner telescoping segments. The last segment has a rotatable distal end with a concave tip to specifically fit a portion of the end of a cylindrical or oval-shaped raised button on certain device models. The button about 0.76 cm (0.3") diameter and half to one times the height. The distal end is rotated for a relatively perpendicular depressing of the device button when the device is located on an upper wall location. It is commercially available currently.

Disadvantages: a. The 14 metal telescoping segments may be relatively heavy while aiming at the button and relatively difficult to manufacture; b. The segments may be subject to breakage when extended; c. The concave shape at the tip only fits a small portion of the raised cylindrical and oval-shaped buttons and may not depress the button if not nearly perpendicular to it; d. Relatively few device models have those button shapes; e. The tip may not be suitably shaped for depressing the button on many of the other device models, including buttons depressed in device surface; and f. The costs of materials and manufacturing result in a comparatively high sales price; g. No loop for hanging convenience.

2. U.S. Pat. No. 6,460,910 (2002) to Prass: "Device for testing emergency illumination and detection equipment".

The plastic handle has an attached metal tool head at the distal end, and can attach a separate telescoping assembly at the proximal end. The handle has finger ridges and a thumb rest of thermoplastic. The tool head is of steel or aluminum and may be covered with a durable coating such as rubber to prevent rust and facilitate friction. It is for activating out of reach device switches, toggles, pull chains and to depress buttons. The head has two opposing perpendicular branches midway configured primarily for pushing up or pulling down. Toward the distal end, the head curves 90 degrees perpendicular to the branches, and has two cones, one on top to push up into a depressed Button and one on the bottom to push down on a Button.

Disadvantages: a. Rather short, without the separate telescoping assembly; b. Bottom cone cannot push button on ceiling or wall device; c. Top cone may not push button when raised adjacent surface on device; d. Top cone may not be able to depress button on wall-mounted device; e. With assembly cost, the materials and manufacturing costs result in a comparatively high sales price; f. Telescoped assembly heavy and may break; g. Branches irrelevant for pushing buttons; h. No loop or similar for hanging convenience.

3. U.S. Pat. No. 4,422,682 (1983) to O'Connell: "Device for checking and resetting smoke alarms".

An elongated wooden rod of 2.54 cm (1.00") diameter with two functional ends. One end has four small projections for depressing the button on an alarm or detector device. Two of these projections extend from the end of a short circular base and are for the device on a ceiling, while the other two are on either side of the base are for the device on a wall. One type of projection on both the end and side is a short narrow rod for the button depressed below the surrounding surface of the device. The other type of projection on the end and side is a rod with a circular cap on its end for the button rising above the surrounding surface of the device. On the top of the base is a loop for hanging. The other end of the elongated wooden rod is a flat triangular shape to fan away smoke within and around the smoke detector. Just before the fan is a hook and magnet for hanging. In the 2nd embodiment, the elongated rod is metal with telescoping segments and a metal collapsible fan of long flat leaves forming the same triangular shape and size.

Disadvantages: a. The wooden rod is short, and the fan effectively shortens it more; b. The telescoped rod is cold metal to hold, comparatively heavy, harder to aim, and may break; c. The costs of materials and manufacturing results in a comparatively high sales price, d. Loop makes hook and magnet redundant, or visa versa; e. One of the projections on the base may obstruction the other from hitting the button; and f. The circular base may obstruct the view of either projector tip and button especially when a small button and at the wall location.

4. U.K. patent 2,478,295 (2011) to Zarrinde: "Aid for testing a smoke detector, with reminder alarm".

A hollow tube with soft grip handle totaling 0.48 m (19") long, with one or two adjustable extensions, a looped cord for hanging or wrist attachment at the proximal end, and a rubber distal end shaped for a snug fit on the detector's button. The distal end is for depressing the button on a ceiling mounted detector. Also in the handle are a battery powered reminder alarm, a battery, and a charger, a possible solar cell, a beeper, and a LED. Other embodiments include a light, an AC battery charger, a smoke generator, and a sensor.

Disadvantages: a. Only 0.48 m (19") long unless extension(s) added; b. Snug tip fit sounds like tip on patent number 1. U.S. Pat. No. 9,422,143 (2016) to Truscott with its problems, which may not be best for other-shaped buttons and when raised surface adjacent to the button; c. May have problems with a wall-mounted detector; d. All the non-button pushing items in the handle may make it heavy, awkward in the hand, and hinder the button pushing function; e. The costs of materials and manufacturing for all the non-button pushing items results in a comparatively high sales price.

5. U.K. patent 2,298,492 (1996) to Lane: "Testing alarms".

A handgrip with three telescoping metal segments ending in a shape that closely fits on the alarm button. The handgrip has a flat surface with a slider as a test-time reminder.

Disadvantages: a. Three metal segments may be heavy, breakable, and hard to aim; b. Close tip fit sounds like tip on patent number 1. U.S. Pat. No. 9,422,143 (2016) to Truscott with its problems, may not be best for other-shaped buttons and when raised surface adjacent to the button; c. The costs of materials and manufacturing may result in a comparatively high sales price; d. No loop or similar for hanging convenience.

Advantages

To further elaborate on the above Introduction, here are the specific names and the number of the Subject Items used in the text hereafter. This Application concerns the four Actuation Types of article Subject Items, fully defined in the 3rd Embodiment: an improved elongated hand Tool, a Pole, which comprises a Pole Body, a possible Extension or two or none, and a Pole Point at the distal end; two Extensions; five novel uniquely-shaped attachable points, Pole Points, for three Different Device Situations; and these points modified to a minimum of twenty one distinct points, Other-Pole Points, for attachment to the Poles of Another kind, that can reach further than the Pole with two Extensions. The Pole Body has a Looped Cap at the proximal end for hanging.

It is judged that the four Types of Items have all or most of the advantages or solutions and overcome the disadvantages or problems of the five Prior Art cited in that previous section. The following numbered descriptions list of Item Advantages is followed by lettered Prior Art Disadvantages list and the number(s) of the related Advantage(s).

Advantages of Subject Items

Here are one or more aspects of the advantages of the four Types of Items in shortened and numbered descriptions of their design and their use aspects:

1. The Pole with two Extensions and the conical Straight Pole Point is 1.29 m (51") long providing a 1.37 m (4.5') person 3.01 m (9' 10.5") reach and a 1.98 m (6.5') person 3.75 m (12.3') foot reach.
2. Heavy metal, breakable, costly telescoping segments are not needed.
3. If additional length is needed, the Other-Pole Points on a longer Pole of Another can provide that additional reach.
4. The circular Pole Body and Extensions are 2.16 cm (0.85") diameter, of modified hollow black Schedule 80 PVC ½ Piping which is comparatively light in weight and of suitable strength. The modified back piping may be unique world-wide with female V-threading on the inside distal-end surface versus the standard male V-threading on the outside distal-end surface.
5. The Straight and Angled Pole Point's Cone with the distal end spherical Tip. of plastic or rubber. provide unobstructed view of the Button.
6. The Straight Pole Point provides for ceiling-mounted devices, and the Angled Pole Point provides for wall-mounted devices, both can provide for perpendicular pushing of the Button.
7. The Truncated Straight and Truncated Angled Pole Points, with the cylindrical hollow distal end, provide a more encompassing fit over the raised 0.76 cm (0.3") diameter Button.
8. Making the Pole Body and Extensions from the Piping and the Points cast with the same Polyvinyl Chloride plastic by a skilled person in the field is comparatively easy and cost effective, and for the manufacturer as well.
9. The designs of the Subject Items provide principally for the Subject Purpose, to depress the Button on an Alarm or Detector Device.
10. Item designs provide better functionality with all Device models and their Buttons.
11. The two conical Pole Points easily slide down to the Button when there is a raised adjacent surface on some Device models.
12. The Cone, with spherical Tip, on the Straight and Angled Pole Points provide an unobstructed minute point of contact, especially effective with depressed Buttons below the Device surface.

13. The 2.16 cm (0.85") diameter circular cross-section, regular smooth surface, and neutral temperature of the plastic Pole Body and Extensions provide for hand comfort and ease of use.

14. The Looped proximal end of the Pole Body provides for hanging.

DISADVANTAGES OF PRIOR ART

Here are the lettered disadvantages of the five Prior Art cited followed by the numbered Advantages of the Subject Items:

Prior Art 1: U.S. Pat. No. 9,422,143 (2016) to Truscott, the "handheld extendable tool with rotatable tip to fit smoke detector button".

a. Telescoping metal segments relatively heavy—2, 4; relatively difficult to make—8.

b. Subject to damage—2, 4.

c. Tip only fits small portion of those buttons—7; perpendicular pushing—6.

d. Few device models with these button shapes—10.

e. Not best for other buttons—10, when depressed button & raised surface—11, 12.

f. High costs—2, 8.

g. No loop—14.

Prior Art 2: U.S. Pat. No. 6,460,910 (2002) to Prass, the "emergency illumination and detection equipment testing device".

a. Short, without the telescoping assembly—1, 3.

b. Botton cone not for device locations—6.

c. Top cone not when adjacent raised—11.

d. Top cone not for wall device—6.

e. High sales price—2, 8.

f. Heavy and breakable—2, 4.

g. Irrelevant parts for Subject Purpose—9.

h. No loop—14.

Prior Art 3: U.S. Pat. No. 4,422,682 (1983) to O'Connell, the "smoke alarm checking and resetting device".

a. Fan shortens length more—1, 3.

b. When telescoping metal segments relatively heavy and breakable—2, 4; cold—4, 13; hard to aim—10, 13.

c. Costly—2, 8.

d. Hook and magnet redundancy—10.

e. One projection on base may obstruct the other—10.

f. Base obstructs view of tip and button especially at wall—5.

Prior Art 4: U.K. patent 2,478,295 (2011) to Zarrinde, the "smoke detector testing aid, with reminder alarm".

a. Short unless extensions added—1, 3.

b. Snug fit of tip on button problems—7; not best for other buttons—10; when raised surfaces—11.

c. Wall location problems—6.

d. Additional parts—9; heavy—2, 4; hand use—13; hinder button pushing—9, 10.

e. Costly non-button pushing parts—8.

Prior Art 5: U.K. patent 2,298,492 (1996) to Lane, the "alarm tester".

a. Three medal segments may be heavy and breakable—2, 4, harder to aim—10.

b. Close fit of tip on button problems—7; not best for other buttons—10; when raised surfaces—11.

c. Costly—2, 8.

d. No loop—14.

SUMMARY

The best mode is an elongated hand tool, extensions for additional reach, some attachable distal end points for different situations, and many end points modified with different attachment methods to a different kind of tool by others for further reach. Many specific features provide effective functionality, including improvements over Prior Art.

FIGS. 1-15

The Third Embodiment is better understood with the aid of the drawings and the following figure descriptions.

Figures 1, 2, 3, 4, 5, 6, 7, 8, 9, 10, 11, 12, 13, 14, 15:
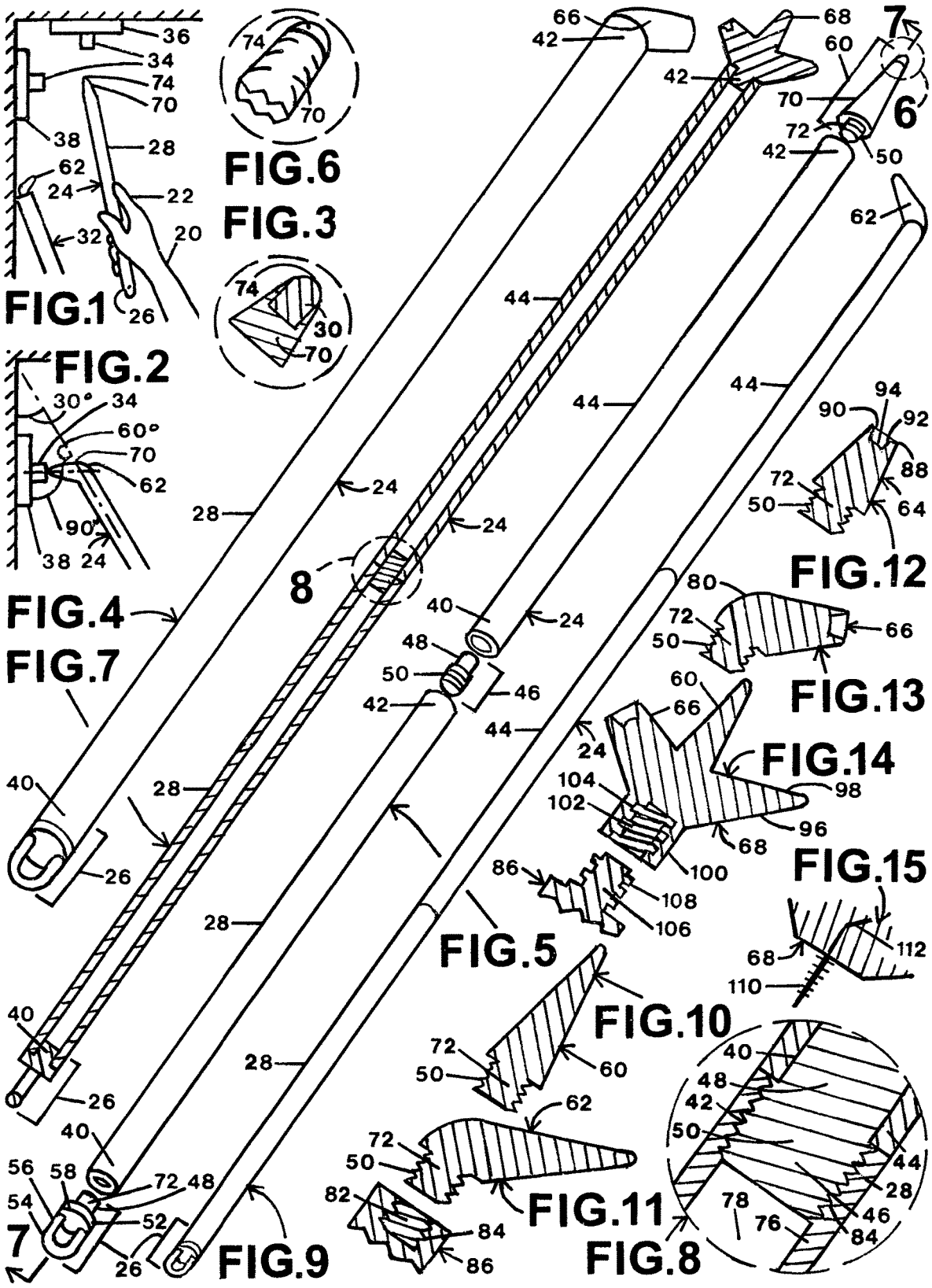
FIG. 1 is a side elevation view of the situation and operation of the Pole pushing the Button on out of reach Devices on the ceiling or upper wall, and also the end of a Pole of Another kind, against the wall, with an Angled Pole Point attached.
FIG. 2 is a side elevation view of the orientational issues of the Angled Pole Point.
FIG. 3 is an enlarged partial isometric view in longitudinal section of the Point's distal Cone having an enclosed rubber cylinder with exposed spherical Tip. versus FIG. 6's plastic Tip.

FIG. 4 is an isometric view of the 0.48 m (19") Pole with the Looped Cap proximal end, the 2.16 cm (0.85") diameter 0.41 m (16") long hollow cylindrical Body and the Truncated Angled Pole Point distal end (making the length a little less than 0.48 m (19").

FIG. 5 is an exploded isometric view of the 0.89 m (35") Pole with the Looped Cap proximal end, the Body, the hidden Connector, the 2.16 cm (0.85") diameter 0.41 m (16") long Extension, and the Straight Pole Point distal end with references to FIGS. 6-7.

FIG. 6 is an enlarged partial perspective view of the distal Cone with its plastic spherical Tip, versus FIG. 3's rubber Tip.

FIG. 7 is an isometric view in longitudinal section of the hollow 0.89 m (35") Pole Body (review FIGS. 5 and 8), the Loop capping the proximal end, the Connector connecting the Body to the Extension with reference to FIG. 8, and the Combination Pole Point at the distal end.

FIG. 8 is an enlarged partial view in longitudinal section of the 0.89 m (35") Pole (review FIGS. 5 and 7) showing the Body, the Extension, and with the two Connector halves, gluing or screwing them together. Note the female American Standard V-shaped Threading inside the Pole Body and the male Threading on the Connector half. The walls are 0.38 cm (0.15") thick.

FIG. 9 is an isometric view of the 1.29 m (51") Pole with the Looped Cap proximal end, the Body, the two Extensions, and the Angled Pole Point distal end (making the length a little less than 1.29 m (51").

FIG. 10 is an isometric view in longitudinal section of the Straight Other-Pole Point. On the proximal end of the Point there is the solid Connector Portion with male American Standard V-shaped Threading for screwing into the inside female V-shaped Threading in the hollow distal end of the Pole of Another kind that has further reach.

FIG. 11 is an isometric view in longitudinal section of the Angled Other-Pole Point. On the proximal end of the Point there is the solid Connector Portion with male American Standard V-shaped Threading for screwing into the inside female V-shaped Threading in the hollow distal end of the Pole of Another kind that has further reach.

FIG. 12 is an isometric view in longitudinal section of the Truncated Straight Other-Pole Point. On the proximal end of the Point there is the solid Connector Portion with male American Standard V-shaped Threading for screwing into the inside female V-shaped Threading in the hollow distal end of the Pole of Another kind that has further reach. The truncated end is hollow with circular sloping walls and part of a convex sphere at the base.

FIG. 13 is an isometric view in longitudinal section of the Truncated Angled Other-Pole Point. On the proximal end of the Point there is the solid Connector Portion with male American Standard V-shaped Threading for screwing into the inside female V-shaped Threading in the hollow distal end of the Pole of Another kind that has further reach. The truncated end is hollow with circular sloping walls and part of a convex sphere at the base.

FIG. 14 is an isometric view in longitudinal section of the Combination Other-Pole Point of a central Straight Point, shortened Angled Point on one side, and Truncated Angled Point on the other side. On the proximal end of the Point there is the hollow Connector Portion with female Universal Acme Trapezoidal-shaped Threading for screwing onto the male Universal Acme Trapezoidal-shaped Threading on the solid projected distal end of the Pole of Another kind that has further reach.

FIG. 15 is a partial isometric view in longitudinal section of the Screw Combination Other-Pole Point with the screw Connector Portion to screw into the wooden or similar material of a different type of a Pole of Another for further reach.

| Drawing - Reference Numerals | | | |
|---|---|---|---|
| FIG. 1 | | | |
| 20 | right arm | 22 | finger clasped hand |
| 24 | elongated Tool or Pole | 26 | Looped Cap |
| 28 | Pole Body (no Exten.) | 32 | Pole of Another kind |
| 34 | Button | 36 | ceiling Device |
| 38 | wall Device | 62 | Angled Pole Point |
| 70 | Cone | 74 | Spherical Tip |
| FIG. 2 | | | |
| 24 | elongated Tool or Pole | 34 | Button |
| 38 | wall Device | 62 | Angled Pole Point |
| 70 | Cone | | |
| FIG. 3 | | | |
| 24 | cone | 28 | Spherical Tip |
| 30 | rubber cylinder | | |
| FIG. 4 | | | |
| 24 | elongated Tool or Pole | 26 | Looped Cap |
| 28 | Pole Body | 40 | non-threaded, 1st Attach. Method |
| 42 | V-threads, 2nd Attach. Meth. | 66 | Truncated Angled Pole Point |
| FIG. 5 see FIG. 4 for 24, 26, 28 & 40 | | | |
| 42 | V-threads, 2nd Attach. Meth. | 44 | Extension |
| 46 | Connector | 48 | non-threaded, 1st Attach. Meth. |
| 50 | V-threads, 2nd Attach. Meth. | 52 | middle segment |
| 54 | U-shaped Loop | 56 | straight Loop leg |
| 58 | small rounded edge | 60 | Straight Pole Point |
| 70 | Cone | 72 | Connector Portion |
| FIG. 6 | | | |
| 70 | Cone | 74 | Spherical Tip |
| FIG. 7 | | | |
| 24 | elongated Tool or Pole | 26 | Looped Cap |
| 28 | Pole Body | 40 | non-threaded, 1st Attach. Meth. |
| 42 | V-threads, 2nd Attach. Meth. | 44 | Extension |
| 68 | Combination Pole Point | | |
| FIG. 8 | | | |
| 28 | Pole Body | 40 | non-threaded, 1st Attach. Meth. |
| 42 | V-threads, 2nd Attach. Meth. | 44 | Extension |
| 46 | Connector | 48 | non-threaded end |
| 50 | threaded end | 76 | 0.38 cm (0.15") wall thickness |
| 78 | hollow space | 84 | V-threads, 0.13 cm (0.05") high |
| FIG. 9 | | | |
| 24 | elongated Tool or Pole | 26 | Looped Cap |
| 28 | Pole Body | 44 | Extension |
| 62 | Angled Pole Point | | |
| FIG. 10 | | | |
| 50 | male V-threads, 2nd Att. Meth. | 60 | Straight Other-Pole Point |
| 72 | Connector Portion | | |

-continued

| Drawing - Reference Numerals | | | |
|---|---|---|---|
| FIG.11 | | | |
| 50 | male V-threads, 2nd Att. Meth. | 62 | Angled Other-Pole Point |
| 72 | Connector Portion | 80 | 60 degree Elbow |
| 82 | hollow space | 84 | female V- thread, 2nd Att. Meth. |
| 86 | Pole of Another, distal end | | |
| FIG.12 | | | |
| 50 | male V-threads, 2nd Att. Meth. | 64 | Truncated Straight Other-Pole Pt. |
| 72 | Connector Portion | 88 | small rounding inward |
| 90 | 1.27 cm (0.5") diameter | 92 | circular walls |
| 94 | 0.89 cm (0.35") convex sphere | | |
| FIG. 13 | | | |
| 50 | male V-threads, 2nd Att. Meth. | 66 | Truncated Angled Other-Pole Pt. |
| 72 | Connector Portion | 80 | 60 degree Elbow |
| FIG. 14 | | | |
| 60 | Straight Other-Pole Point | 66 | Truncated Angled Other-Pole Pt. |
| 68 | Combination Other-Pole Point | 86 | Pole of Another, distal end |
| 96 | Angled Pole Point | 98 | length 1/4 shorter |
| 100 | Connector Portion | 102 | hollow space |
| 104 | female Trapezoidal Thr'ds 3. A.M. | 106 | projected end |
| 108 | male Trapezoidal Threads, 3rd Attachment Method | | |
| FIG. 15 | | | |
| 68 | Screw Combination Other-Pole Pt. | 112 | screw Connector Portion |
| 112 | twisted end | | |

DETAILED DESCRIPTION—INTRODUCTION

Note: words specific to this Nonprovisional utility Application often are capitalized.

A common problem in most homes is that Alarm or Detector Devices are out of reach for most residents since they are located on a ceiling or an upper wall within inches of the ceiling. Therefore, in an Emergency, the resident may climb onto a chair, with the possibility of falling and injury or grab any available elongated object, such as a clothes hanger, to push a Button on the 85 dbl screeching Alarm. For the manufactures' recommended regular Testing of one in a studio to as many as ten Alarms and/or Detectors in a multi-story home, the resident will probably get an elongated hand Tool to depress the Button on the Device—the Subject Purpose.

This article of manufacturing Application concerns the four article Types of Actuation Items: an improved elongated hand Tool, a Pole, FIGS. 4, 5, 7, 9 of the drawings, which comprises a Pole Body 24 (with a Looped Cap 26 at the proximal end for hanging convenience), a possible Extension 44 or two or none, and one Pole Point at the distal end; five novel distinctly-shaped attachable points, Pole Points 60, 62, 64, 66, 68 for different uses, three Different Device Situations and certain Button shapes and sizes, as the three Types of Items; and these five modified to a minimum of twenty one distinct points, Other-Pole Points FIGS. 10-15, for attachment to the different Pole of Another kind that are the fourth Type of Item. All these Types of Actuation Items, with the common purpose, to actuate the Button 34 FIG. 1 on out of reach Devices 36, 38 such as fire Alarms and smoke, gas (often CO) or heat Detectors. While there are many kinds of commercially available Poles of Another with related attachments, none appear to have the unique advantages of these four Types of Actuation Items for the Subject Purpose.

The Detailed Descriptions of the first three Embodiments are the physical elements and their features of the Subject Items. The Third is best mode, the Fourth only possible variations. Each of these are in different degrees of specificity, which are defined in the first paragraph of each Description. Terms for the related Item elements and features therein are followed by reference numbers shown in the 15 figures on the drawings except for the Second and Fourth Embodiments which are NOT shown in the drawings.

The operation of the Pole is, as shown in FIG. 1, a person holding the proximal end of the Pole 24 with the person's dominate right or left hand in a preferably thumb-forward clasped hand configuration 22 with the arm 20 almost fully extended and aimed at and then depressing and releasing or depressing, holding a few seconds, then releasing the Button 34 on the out of reach Devices 36, 38 located on the ceiling or on the upper wall within inches of the ceiling. The operation of the different longer Pole of Another 32, with the Angled Other-Pole Point 62 attached, is the same but possibly with two hands.

The various descriptions in the following Embodiments and later Ramifications contain specifics, these should not be construed as limiting their scope but only as examples. While other materials, configurations and dimensions are suitable and functional, it is believed the Embodiment designs are based on significant functional advantages. Actually, the scope of the Embodiments is determined by the appended Claims and their legal equivalents, rather than the examples given.

Detailed Description—The First Embodiment is deleted, along with Claim 1, and FIG. 3 is amended to a different element

Detailed Description—Second Embodiment

This Embodiment is a ramification with few limitations, a generalized description of the four Types of Actuation Items, minimizing their aspects, elements, and features, though still for same the Actuation Purpose. As such, they are not specifically on the Drawing, so no reference numbers.

The Pole: of a Pole Body, possible Extensions, and of one of the Pole Points.

The Pole Body: of a length sufficient for a short woman with the longest Pole (two Extensions) to reach a ceiling of common height; of a cylindrical shape, surface texture, material, and weight, and a dark color; with a Looped Cap attached to the Pole Body at the proximal end; in the distal end a method for attachment of the Extensions or the Pole Points; or different methods of attachment.

The Extensions: of the Pole Body length, cross section, surface texture, material, weight, and color; and of the Pole Body attachment method at the distal end; of a proximal end, a Connector, with complimentary methods for attachment to the proximal end of that extension and distal end of the Pole Body or another Extension; or of different methods of attachment. The Pole may be of different lengths depending on if or how many Extensions are attached.

The Pole Points: each of two segments, a common proximal attachment structure, a Connector Portion, of a complimentary method for attachment to the distal end of the Pole Body or the Extensions, and distinctly-shaped distal Point-End Configurations; and of the Pole Body material and color.

The Other-Pole Points: modified Pole Points each of the two segments, the distinct distal Point-End Configurations of the Pole Points, and modified proximal Connector Portions with either of the two or more methods for mating attachment to either of the hollow or projected distal ends of the commercial available Poles of Another kind; and of the Pole Body material and a metal, and the Pole Body color and a metal color.

Operation—Second Embodiment

FIG. 1 shows the user's dominate arm and a specific hand configuration holding and aiming the Pole about to depress the Button of an out of reach Device on the ceiling or wall location.

When the longest Pole with Extensions is not long enough for the shortest user in the home or building, a sufficiently long Pole of Another kind for further reach can be used with the Other-Pole Points, with their advantages, whose Connector Portion matches the hollow or projected distal end attachment method.

The Pole Body cross section, surface texture, material, and weight are selected partially for comfort in the hand. The dark color is selected for visual contrast from the commonly light color of the Button and Device. The Looped Cap at the proximal end of the Pole Body is for hanging.

The distinctly-shaped distal Point-End Configurations of the Pole Points and Other-Pole Points are selected for either different Device locations or for a different Button size and shape on certain Device models. One Other-Pole Point has a different Connector Portion to attach to the distal end of a Pole of Another of a different type of material.

Detailed Description—Third Embodiment—FIGS. 1-15

This Embodiment is considered the best mode of the article of manufacture for the four Types of Actuation Items, covering all the elements and their features selected for specific significant advantages, all for the same Actuation Purpose. These are shown on the 15 figures of the drawings.

The Devices

The need for the Items is based on if there are any Alarm or Detector Devices in the residential home or non-residential building. The Devices are required by law in most states, especially those residential structures newly constructed or re-constructed. In the U.S. in 2014, there were 134 million housing units of which 93% had the Devices, 80% in UK homes. It is recommended by the Device manufacturers that one and or the other type Device be located in all bedrooms, in the hall near the bedrooms, in some living and or dining rooms, other rooms like a separate study, and maybe in a basement, attic and or attached garage. This may mean one in a studio-size unit or maybe ten or more in a large multi-story unit. Other types of residences might include retirement structures, high rise residential buildings, hotels and motels. Non-residential buildings include hospitals, schools, offices, commercial and industrial structures. Then there is the international use of the Devices in developed countries and, especially in the modern portions of the larger cities in many under or undeveloped countries around the world. In total, a very significant market or need for the Devices.

These Devices commonly include fire Alarms and smoke, gas (often CO) or heat Detectors. Such Devices 36, 38 FIG. 1 have a Button 34 to de-actuate, actuate, or test their power source. The Actuation Items are designed to depress or depress and hold for a few seconds such Buttons. There are four major US manufactures of these Devices, who produce about 175 different models. They include these different types: Photoelectric, Ionization, Carbon Monoxide, Combination CO/Smoke Alarms, Hardwired AC Operated, Plug-in AC Operated, Battery Operated, and 10-year Battery Operated. World wide, China produces five times that amount. These US models have about two dozen different Button shapes and sizes, including a raised 0.76 cm (0.3") diameter cylindrical and oval-shaped Button. Some of these models have raised Buttons, others level or depressed Buttons relative to the surrounding Device surface, and some models have raised portions adjacent to the Buttons which may obstruct some tools from depressing the Button.

The Four Types of the Actuation Items

Four Types of Actuation Items: Pole Body and Extensions, of the same lengths of black Schedule 80 PVC ½ Piping, and five distinct Pole Points, as the three Types of Items, and the five modified to a minimum of twenty one different Other-Pole Points to attach to the Poles of Another kind for further reach, as the fourth Type of Item; both Point kinds of the same Polyvinyl Chloride material and black color (except one includes a metal screw and metal color); all with the common Subject Purpose to actuate out of reach Devices.

The Pole:

The elongated hand Tool, the Pole, comprises the Pole Body, with one or two Extensions or none, and one of the five attachable distinct Pole Points at the distal end. The 0.41 m (16") Pole Body 28 with its 2.03 cm (0.8") Looped Cap 26 and with 0, 1 or 2 0.41 m (16") Extensions 44, make the lengths of 0.48 m (19") FIG. 4, 0.89 m (35") FIGS. 5, 7, and 1.29 m (51") FIG. 9, all when the Straight Pole Point 60 FIG. 5 of 5.58 cm (2.2") length is attached.

The Pole Body:

The 0.41 m (16") long hollow FIG. 7 Pole Body 28 FIG. 4: is made of modified black Schedule 80 PVC ½ Piping of 2.16 cm (0.85") diameter, 0.38 cm (0.15") wall thickness 76 FIG. 8, and with a smooth surface without casting ridges. This unique Piping is modified instead with female American Standard V-shaped threading 84 FIG. 8 of 0.13 cm (0.05") height on the inner side of the distal end 42 FIG. 4, and it is of sufficient length for secure attachment, as a Second Attachment Method. Of additional length, at the proximal end, is the solid Looped Cap 26 FIG. 5 of 2.03 cm (0.8") exposed axial length. The proximal end is U-shaped 54, 56. The hidden non-threaded Connector Portion 48 at the distal end, of sufficient length for secure attachment, is permanently glued by manufacturer, as a First Attachment Method, into the hollow proximal end 40 of the Pole Body 28.

The Extensions:

Each Extension 44 FIGS. 5, 7, 9 has the same physical characteristics as the Pole Body 28. But, at the proximal end, there is a Connector 46 FIG. 5 instead of the Looped Cap 26. The distal half segment 48 of the Connector 46 is non-threaded, permanently glued in by manufacturer, and of sufficient length and diameter to snuggly and securely fit into the hollow proximal end 40 of the Extension 44, as the First Attachment Method. The proximal half segment 50 of the Connector 46 has male American Standard V-shaped threading 50 FIG. 8 of 0.13 cm (0.05") height, as the Second Attachment Method, and it is of sufficient length and diameter to securely screw into the female threaded distal end 42 of the Pole Body 28 or of another Extension 44.

The Pole Points:

The five novel and distinct attachable Pole Points 60, 62, 64, 66, 68 are of the same Polyvinyl Chloride material and black color as the Pole Body 28. Each Pole Point has two segments: a common proximal end, or Connector Portion segment 72 FIG. 5 of sufficient length and diameter and with male American Standard V-shaped threading 50 thereon, as the Second Attachment Method, to securely screw into the female threaded distal end 42 of the Pole Body 28 or the Extension 44; and the five unique distinctly-shaped distal Point-End Configurations, for the three Different Device Situations, are distinguished in the following descriptions. The five Pole Points are:

Note that four of the five Pole Points are shown in FIGS. 4, 5, 7, 9. All five of the Pole Points are enlarged as longitudinal sections in the six Other-Pole Points shown in FIGS. 10-15. The Combination Other-Pole Point 68 in FIG. 14 blends three of the Pole Points into one. The Screw Combination Other-Pole Point 68 in FIG. 15 has a screw 110 as it's Connector Portion.

The Straight Pole Point 60 FIGS. 5, 10: following the common Connector Portion segment 72, the proximal end of the Point-End Configuration starts a Cone 70 FIG. 6 of 2.16 cm (0.85") Piping diameter reducing to 0.51 cm (0.2") diameter 70 ending in a little less then half of a spherical Tip 74 of 0.25 cm (0.1") radius, totaling an exposed axial length of 5.58 cm (2.2").

A possible alternative rubber cylinder 30 is shown in FIG. 3.

The Angled Pole Point 62 FIGS. 9, 11: following the common Connector Portion segment 72, the proximal end of the Point-End Configuration starts with a 2.16 cm (0.85") Piping diameter twisting Elbow 80 on which sits the 5.58 cm (2.2") long Cone 70 and Tip 74 of the Straight Pole Point 60. The Elbow 80 turns the distal axis of the Cone 70 and Tip 74 sixty degrees from the axial direction of the Connector Portion 72. FIG. 2 shows the Angled Pole Point 62 with its Cone 70 approaching the Button 34 at ninety degrees. With this Point 62 on the Pole 24, a slight twist of the user's hand away from the side of the user's head will increase visibility of the Cone's Tip 74 from obstruction by the Elbow 80 of this Point 62.

FIG. 3 shows the cone's possible rubber cylinder 30.

The Truncated Straight Pole Point 64 FIG. 12: following the common Connector Portion segment 72, the proximal end of the Point-End Configuration starts with the Cone 70 of the Straight Pole Point 60 which is then truncated at the exposed axial length of 2.79 cm (1.1") with the distal end a 1.27 cm (0.5") diameter 90. This circular edge of the distal end 90 has a very small radius rounding 88 which extends into an open hollow space with conical walls 92 intercepting perpendicularly the circular edges of a partial convex sphere 94 such that the minimal depth of hollow space will accept more than half the length of the Button on those Device models with the raised 0.76 cm (0.3") diameter cylindrical or oval-shaped Buttons.

The Truncated Angled Pole Point 66 FIGS. 4, 13: following the common Connector Portion segment 72, the proximal end of the Point-End Configuration starts with the 2.16 cm (0.85") Piping diameter twisting Elbow 80 on which sits the Truncated Cone of the Truncated Straight Pole Point 64. The Elbow 80 turns the distal axis of the Truncated Cone sixty degrees from the axial direction of the Connector Portion 72.

The Combination Pole Point 68 FIGS. 7, 14: following the common hollow 102 Connector Portion segment 100 FIG. 14, from the proximal end of the Point-End Configuration starts the Cone 70 and Tip 74 of the Straight Pole Point 60, blended together on one side the modified Angled Pole Point 96 whose Cone 98 has been shortened one fourth of its axial length, and on the opposite side the Truncated Angled Pole Point 66. Note that FIG. 14 shows a different Connector Portion configuration 100, versus FIG. 7, explained in the following Other-Pole Points description.

The Other-Pole Points FIGS. 10-15: the minimum of twenty one novel and distinct attachable Other-Pole Points are of the same Polyvinyl Chloride material and black color as the Pole Body. The exception is a metal screw 110 FIG. 15 as the Connector Portion of the one Screw Combination Other-Pole Point 68 with the metal color of the screw. Each of the Other-Pole Points has two sections: the novel and unique distinctly-shaped distal Point-End Configurations of the five Pole Points; and at their proximal ends, the minimum of two shapes and sizes of Connector Portions solid 72 and hollow 102 of sufficient length and diameter and with the compatible threading 50, 104 to securely screw into or onto the mating threading of hollow 82 or solid projected 106 distal end of the Poles of Another kind 86 respectively. The compatible threading includes male 50 or female 84 American Standard V-shaped threading and male 108 or female 104 Universal Acme Trapezoidal threading. Because of these differences in the Point-End Configurations, the Connector Portion matching the Pole of Another end and the threading types, twenty of the distinct Other-Pole Points may be sold in four different group packages. Each of the four groups has the five distinct Point-End Configurations 60, 62, 64, 66, 68 at the distal end. In the first group at the proximal end, the common Connector Portion is solid 72 with male American Standard V-shaped threading 50, matching the Pole of Another's 86 hollow end 82 with the same threading 50 but female 84. In the second group at the proximal end, the common Connector Portion is also solid 72 but with male Universal Acme Trapezoidal threading 108, matching the Pole of Another's 86 hollow end 82 with the same threading 108 but female 104. In the third group at the proximal end, the common Connector Portion is hollow 102 with female American Standard V-shaped threading 84, matching the Pole of Another's 86 solid end 106 with the same threading 84 but male 50. In the fourth group at the proximal end, the common Connector Portion is also hollow 102 but with female Universal Acme Trapezoidal threading 104, matching the Pole of Another's 86 solid end 106 with the same threading 104 but male 108. The American Standard V-shaped threading is the Second Attachment Method, and the Universal Acme Trapezoidal threading is the Third Attachment Method. The twenty first distinct Other-Pole Point is the Screw Combination Other-Pole Point 68 with its screw 110, the third shape and size of Connector Portion to securely screw into the wooden or similar material distal end of a different type of a Pole of Another kind, as the Fourth Attachment Method. The non-point end of the screw 112 within the Point-End Configuration 68 is twisted to be secure. There could be more than twenty one Other-Pole Points depending on the variations of the distal ends of the most popular Poles of Another. The Screw Combination Other-Pole Point 68 may be sold as a fifth group package, and the Pole with the five Pole Points may be sold as a sixth group package.

Other Details:

The Piping could be changed to white Schedule 40 PVC ½ Piping, ABS, or of a "green" material for the Piping, if the color could be changed to Black and if it were less expensive. Similarly, the Piping could possibly be of the common dark grey type, if significantly less expensive, though there are casting ridges on the surface. Also refer to the DETAILED DESCRIPTION—Fourth Embodiment and the Scope, Ramifications, and Conclusions section for additional variations or alternatives.

There may be six possible Accessories, which resolve certain operational problems, that may be added to the six sales group packages. The Accessories are discussed in the Conclusions, Ramifications, and Scope section.

While it is recognized that other materials, configurations and dimensions are suitable and functional, it is believed the Embodiment and Ramification designs are based on significant functional advantages, high-lighted in the following Operation section.

The scope of the Embodiments is actually determined by the appended Claims and their legal equivalents, rather than the examples given.

Operation—Third Embodiment—FIGS. 1-15

The Four Types of Items:

The four Types of the Actuation Items are for the Subject Purpose to Actuate the Button 34 FIG. 1 of the drawings on out of reach Devices 36, 38 which is done to stop the 85 dbl screeching Device or to Test its functionality, and when emergency or regular Testing occasions.

The operation of the Items, to achieve the Actuation Purpose, is simple and easy to use. FIG. 1 shows the user's dominate arm 20 and specific hand configuration 22 holding and aiming the Pole 24 about to depress the Button 34 of an out of reach Device on a ceiling 36 or wall 38 location.

The Items provide convenience and user safety from falling and injury.

There are aspects of handling ease and comfort, interchangeable points, advantages of attachment to the Poles of Another kind, improved visibility, and reachability, as well as the benefit of the five Pole Point Point-End Configurations for the three Different Device Situations.

The screw-on and off attachment of the Extensions 44 FIGS. 4, 5, 7, 9, Pole Points 60, 62, 64, 66, 68, and Other-Pole Points is made easy by the male 50 and female 84 American Standard V-shaped threading, and the male 108 and female 104 Universal Acme Trapezoidal threading.

Attachment of the Other-Pole Points to the Poles of Another kind has the advantages of a method to reach higher than the longest Pole, and a method to provide the benefits of the five Pole Points in the three Different Device Situations.

The Piping and Point plastic material should be competitive in the cost of manufacturing and the price of the sales packages.

The manufacturer permanently glues on the Looped Cap 26 FIG. 5 and Connector 46 non-threaded section 48 so that the user has less to do in attaching the parts in the Pole sales package and in the Pole's regular use.

The reach of a 1.37 m (4.5') short or a 1.98 m (6.5') tall person with the longest 1.29 m (51") Pole on the person's toes is 3.01 m (9' 10.5") or 3.75 m (12.3') respectively.

One might say, the use of the Items for the Actuation Purpose generally and specifically improves the overall operation and effectiveness of the various Devices.

Maybe, they also result in feelings of safety, security and confidence for the user.

The Body and Extensions:

The cylindrical cross-section of 2.16 cm (0.85") diameter, the uniquely modified black plastic Piping material of neutral temperature and regular smooth surface without casting ridges, hollow so reduced weight, non-flexible, and of sufficient strength were all selected features to provide use comfort in the hand, especially important when Testing weekly in a large house.

The Looped Cap 26 is of a shape and size to permit its attachment to the Accessory's ?-shaped screw for hanging convenience and to resist breakage.

The Pole Points:

The Points are easily interchangeable by screwing to provide for the three Different Device Situations.

The black color provides contrast visibility from the commonly light-colored Button and Device.

The Cone 70 and Tip 74 FIG. 6 provide unobstructed visibility approaching the Button.

The Cone's 24 rubber cylinder 30 with Spherical Tip 28 FIG. 3 provide friction increase.

The Cone and Tip provide easy access to a depressed Button or sliding down an adjacent raised Device surface to press the Button.

The Cone and Tip provide an unobstructed minute point of contact verse a larger distal end 86 FIGS. 11 and 110 FIG. 14 of the Poles of Another kind which might be obstructed by their inner edge from depressing the Button.

The Straight Pole Point 60 FIG. 5 is configured to depress the Button 34 FIG. 1 on a Device 36 located on the ceiling.

The Angled Pole Point 62 FIGS. 9 and 2 is configured to depress the Button 34 on a Device 38 located on the upper wall within inches of the ceiling.

The Truncated Straight Pole Point 64 FIG. 12 is configured to depress the raised cylindrical or oval-shaped 0.76 cm (0.3") diameter Button on a few models of the Device located on the ceiling.

The Truncated Angled Pole Point 66 FIG. 4 is configured to depress a raised cylindrical or oval-shaped 0.76 cm (0.3") diameter Button on a few models of the Device located on the upper wall within inches of the ceiling.

The Combination Pole Point 68 FIGS. 7 and 14 is configured with blended and modified Straight, Angled and Truncated Point-End Configurations for their three specific Different Device Situations so that the user does not have to switch these Pole Points for these Situations.

The Other-Pole Points 60, 62 FIGS. 10, 11 and 64, 66 FIGS. 12, 13 and 68 FIGS. 14, 15:

The user of the Pole of Another kind can alternately attach one of the five Other-Pole Points, with its specific distal end configuration, and thereby gain the advantage of that Other-Pole Point in one of the three Different Device Situations to achieve the Activation Purpose, but with more reach than the longest Pole of two extensions.

The modified Angled Pole Point 96 FIG. 14, of the Combination Other-Pole Point, is shortened one fourth its axial length 98 to keep from obstructing the use of its Straight Pole Point 60.

The Other-Pole Points will probably be sold in four package groups responding to the type of distal ends 82, 106 FIGS. 11, 14 on the Poles of Another kind 86 and the type of treading respectively, each with the five distinct Pole Points. The Pole, two Extensions and the five distinct Pole Points will be sold separately, as probably will the Screw Combination Pole Point.

Other Features:

FIG. 2 shows that when the Pole 24 with the Angled Pole Point 62 approaches the Device 38 located on the upper wall within inches of the ceiling, the Pole is about thirty degrees from the wall with the resulting axis of the sixty degreed elbowed Cone 70 about ninety degrees to the Button 34 surface.

The Cone 70 FIG. 6 with the spherical Tip 74 at the distal end provides a well directed single minute point of contact. This is in contrast to the larger hollow 82 distal end 86 FIG. 11 or projected 106 distal end 86 FIG. 14 of the Poles of Another kind. These have edges which can visually obstruct the view of the smaller target Buttons, and more importantly they may hit a raised adjacent Device surface instead. This is particularly true when its larger surface is not perfectly perpendicular to the Button surface and when the Button is depressed below the Device surface or when there is the raised surface adjacent to the Button.

Cone's 24 rubber Tip 28 FIG. 3 gives increased friction.

The Building & Testing Disclosure for the 3rd Embodiment discusses, when the Button is depressed below the Device surface or when there is the raised surface adjacent to the Button, that the conical-shaped Point 70 FIG. 6 with the spherical Tip 74 easily slides down onto the Button.

When the user of the longest 1.29 m (51") Pole FIG. 9 can not reach all the Devices in the home, the user can purchase an additional Pole package adding 0.41 m (16") or 0.82 m (32") with the addition of 1 or 2 Extensions respectively. Or, the user can purchase the Pole of Another kind of greater length than longest Pole along with the appropriate package group of Other-Pole Points, sold separately, with their five Pole Point advantages. Probably more than 95% of the Poles of Another kind have a 1.78 cm (0.7") 106 FIG. 14 diameter projected distal end or a hollow 3.81 cm (1.5") 86 FIG. 11 diameter flat distal end, with either of the two threading types 50, 108 to attach various tools.

The hollow distal end 90 FIG. 12 of the two Truncated Pole Points 64, 66 with the conical walls 92 intercepting the convex spherical base 94 can easily encompass more than half of the raised cylindrical or oval-shaped 0.76 cm (0.3") diameter Button on about 11 of the 175 U.S. Device models. This is not as true of the cited 1. U.S. Pat. No. 9,422,143 (2016) to Truscott whose concave-shaped tip only encompasses a much smaller portion of this Button.

Note that the Pole user in a home will generally select which Pole length and Pole Point that will be needed, including possibly the Combination Pole Point in a large two-story structure with multiple Devices. The remaining Items would be stored away, which is augmented by one of the Accessories.

It might be said that the homeowners with these Devices, that use the Activation Items, will avoid fall injury for the users and may experience feelings of safety, security and confidence for both the users and the other members of the household.

A skilled person in the field can probably make the Pole Body 28 FIG. 7 and Extension 44 with the unique black hollow Schedule 80 PVC ½ Piping easily, except possibly for the modified interior V-threading 42 while preferably keeping the exterior surface without casting ridges (desirable, not obligatory). Making the Point-End Configuration shapes of the Pole Points, Connector 46 FIG. 5, and Looped Cap 26 will take some effort possibly using 3D Autocad and a 3D printer. From these shapes, the molds and then the final casts of the five Pole Points and Other-Pole Points of the same Polyvinyl Chloride plastic material can be made. The Screw Combination Pole Point 68 FIG. 15 should be just a little more effort. The operation of the Activation Items for the Activation Purpose is simple and easy as shown in FIG. 1.

Summarizing, the specific aspects of handling, interchangeable Points, visibility, reachability, and the PVC Piping and plastic make the Pole and Points unique, novel, new, different, and advantageous from the cited Prior Art.

Detailed Description—Fourth Embodiment

This Embodiment is a generalized and brief description of some design alternatives that are for the same Actuation Purpose. They are more specifically described in the Conclusions, Ramifications, and Scope section. They are not on the drawings, so no reference numbers.

The Four Types of Actuation Items:

Could alter the length, cross-section, shape, dimensions, surface texture, casting ridges, material, weight, and color of the Items under some circumstances.

For example, instead of black, another dark color such as bright red.

Other Methods of Attachment are possible.

The Body and Extensions:

The lengths of both and/or the number of Extensions could vary.

A solid Pole Body and Extensions would eliminate gluing at the proximal ends, but still require internal treading at the distal ends.

White Schedule 40 PVC ½, ABS or a "green" material Piping could be used instead if they could be dark in color and possibly less in cost.

The Pole Points:

White Schedule 40 PVC ½, ABS or "green" Piping Polyvinyl Chloride plastic could be used if dark in color.

The Cone of the Straight and Angled Pole Points could be shorter or longer, and be thicker or thinner at the end and Tip.

The Cones on the Straight and Angled Pole Points could have a rubber cylinder and Tip, or use the Rubber Cap over the plastic Tip as provided in the Accessories.

A light could be added to the Pole, as in Patent 4. U.K. patent 2,478,295 (2011) to Zarrinde, but it would require recharging.

The Straight and Truncated Straight Pole Points could be altered to a rotatable point, as in Patent 1. U.S. Pat. No. 9,422,143 (2016) to Truscott.

The diameter of the hollow space, at the distal end of the two different Truncated Pole Points, could be widened.

The Loop's cross-sectional diameter could be thicker.

Could eliminate all but the Combination Pole Point and Screw Combination Pole Point.

a. Could add a Push/Pull Pole Point.

b. Could add a Pull Pole Point.

c. Could add a Fan Pole Point.

In the following Ramifications Section, the a.-c. designs are detailed.

The Other-Pole Points:

Could add more Other-Pole Points, in part due to different sizes and shapes of the distal ends of the Poles of Another kind and/or different attachment methods.

Operation—Fourth Embodiment

The Four Types of Actuation Items:

Could alter many of the physical characteristics of the Items, possibly effecting their operation, if they can still achieve the Actuation Purpose.

Instead of black Items another dark color is possible, even bright red, while retaining their visual contrast with the Button and Device.

Other Methods of Attachment could include different threading styles and sizes.

The longer the Pole, the higher the Device could be actuated.

Different shapes and sizes of the distal ends of the Poles of Another kind would add additional Other-Pole Point sales package groups.

The Body and Extensions:

The Body and Extensions could be longer or shorter, and/or the Extensions could be more or less than two which would decrease or increase the use of Poles of Another kind because of the change in the reach of the Pole.

The solid Body and Extensions would be heavier and harder to aim.

White Schedule 40 PVC ½, ABS or a "green" material Piping could be used instead if they had the same physical characteristics.

The Pole Points:

The functioning of the Pole Points would be the same if white Schedule 40 PVC ½, ABS or "green" Piping Polyvinyl Chloride plastic were used if of dark color and of equal or more strength.

A shorter and/or thicker Cone at its end and Tip on the Straight and Angled Pole Points would be less likely to break.

A rubber cylinder and Tip or Rubber Cap, on the Cones of the Straight and Angled Pole Points, would increase friction against the Button more assuring depression.

A light added to the Pole could illuminate the Button in a dark environment.

Rotatable Straight and Truncated Straight Pole Points could be adjusted to perpendicularly depress the Button on a Device on the upper wall within inches of the ceiling, and would eliminate the need for the Angled and Truncated Angled Pole Points.

The cross-sectional diameter of the Loop on the Looped Cap could be thicker to provide additional strength.

Increasing the diameter of the hollow space, at the distal end of the Truncated Straight and Angled Pole Points, would more assuredly encompass the raised cylindrical and oval-shaped 0.76 cm (0.3") diameter Button on those few Device model.

With only the Combination Pole Point, the user would not have to change Pole Points for the three Different Device Situations. The Screw Combination Other-Pole Point is used on the wooden or similar material distal end of a different type of a Pole of Another kind with further reach than the Pole Body and two Extensions.

Could add a Push/Pull Pole Point to both push or pull on the various toggles and switches on a remote Device of that type.

Could add a Pull Pole Point to pull on a light bulb chain.

Could add a Fan Pole Point to dissipate the smoke, gas or heat from within and around a smoke, gas or heat Detector.

The Other-Pole Points:

Could add more Other-Pole Points when there are Poles of Another kind with further reach with different types and dimensions of the distal ends or when there are new Other-Pole Point functions.

SCOPE, RAMIFICATIONS, AND CONCLUSIONS

Note: This rather long section deemed significant for overview and important details.

Scope

The Embodiments of the elongated hand Tool include the Pole Body, some Extensions for additional reach, attachable distal end Points for Different Device Situations, and many modified end Points with different Attachment Methods to another person's Tool for further reach, all to actuate out of reach Devices such as fire Alarms and smoke, gas (often CO) or heat Detectors. The Fourth Embodiment provides some variations in physical features of the four Types of Actuation Items for the Actuation Purpose, as well as some other designs for similar purposes. The specific physical features provide improved functionality over the Prior Art. As stated in the Detailed Description—Introduction, the scope is of the Embodiments is determined by the appended Claims and their legal equivalents, rather than the examples given.

Ramifications

Specific design descriptions of the three additional Pole Point designs a.-c. of the Fourth Embodiment follow:

a. The specific shape of the Push/Pull Pole Point could be: an extended and modified rectangular solid Box of Pole Piping diameter Width, Length of 2.5 times the Width, and Thickness ⅓ the Width; On the distal end of the common Connector Portion, position the Width and Length sides of one end of the Box like the Point-Ends fit; from that end of the Box, inward one Piping Diameter, the Thickness angles upward so that the Other end is about 0.3 Piping Diameter of the Thickness higher; at both Box ends is a modified rectangular-shaped Projection, below on the Other end and above on the opposite Connector Portion end; the length of the Projection is coterminous with the Box end, and the other two directions are of 0.3 Piping Diameter thickness square with the outer side modified arching inward to the other side's end; all exposed edges are slightly rounded.

b. The specific shape of the Pull Pole Point could be: on the distal end of the common Connector Portion sits the circular end, of the Pole Piping Diameter, of the Rest of the Point whose length is 2.25 Piping Diameter; all portions of the Rest are circular; side view appears like a stretched 2-shape, where the curved cap at the distal end is 0.65 of the Diameter and centered above the Base, and added is a straight line extending from the non-connected end of the Base up to a tangent point on the cap, and then that enclosed space is filled in solid so only the outer edges appear; the cap is of 0.2 Piping Diameter thickness.

c. The specific shape of the Fan Pole Point could be: a solid truncated equilateral triangle with the non-truncated side three Pole Piping Diameters long and the other two sides two Piping Diameters long, and of 0.2 Piping Diameter thickness; and the truncated side centered on the distal end of the common Connector Portion.

Some similar and other new comments on the Fourth Embodiment design Alternative items follow:

Could alter most of the physical characteristics of the Items if basically can still achieve the Actuation Purpose, would weigh the advantages gained verse the advantages lost considering effectiveness of operation, features of any competitors, and relative costs of making and selling for example.

The black Item material could be of another dark color such as the dark grey of the common Piping or even bright red and still have the same contrast visibility to the common light colored Button and Device surface.

Other Methods of Attachment could include different threading styles and sizes or possibly having the Looped Cap and or the distal end of the Connector made as part of the Pole Body and/or the Extensions respectively instead of gluing by the manufacturer.

The Body and Extensions could be longer or shorter, and/or the Extensions could be more or less than two. The current Pole's 0.41 m (16") Body and two 0.41 m (16") Extensions with the 5.59 cm (2.2") Straight Pole Point total 1.29 m (51"). With such a Pole a 1.37 m (4.5') person on his or her toes can reach a 3.01 m (9' 10.5") high ceiling, and a 1.98 m (6.5') person on his or her toes can reach a 3.75 m (12.3') high ceiling.

A solid Body and Extensions would be heavier and more difficult to aim at the Button. When two Extensions it might require two hands and effectively shorten the reach. The Connector and Looped Cap would be built in instead of glued in by the manufacturer.

White Schedule 40 PVC ½, ABS or a "green" material Piping could be used instead if they had the same material characteristics, were lower in cost, and could be made dark-colored.

The Cone of the Straight and Angled Pole Points could be shorter and or be thicker at the end and Tip, and would be less likely to break if the distal end of the Pole was dropped on a hard floor for example.

A rubber cylinder and Tip or Rubber Cap, added to the Cones of the Straight and Angled Pole Points, would increase friction against the surface of the Button, especially when approaching at less than perpendicular to the Button. The Rubber Cap over the Tip and a short portion of the Cone could be easier than securing a rubber Tip to the Cone or a rubber cylinder within the Cone ending in a rubber Tip.

A light added to the Cone of the Straight and Angled Pole Points would increase visibility to see the Button better in a dark environment. It may not be worth the trouble to implement, which could include locating and recharging a battery.

A rotatable point, on the Angled and Truncated Angled Pole Points, could be adjusted to more assuredly approach the Button at 90 degrees such as when the Device is on a higher upper wall location. The 1. U.S. Pat. No. 9,422,143 (2016) to Truscott discussed in Prior Art has a rotatable point.

The cross-sectional diameter of the Loop on the Looped Cap at the proximal end of the Pole Body could be thicker to resist breakage if the Pole where dropped on a hard floor on that end.

The hollow space, at the distal end of the Truncated Straight and Angled Pole Points, if enlarged would better encompass the raised cylindrical or oval-shaped 0.76 cm (0.3") diameter Button. This would improve on the 1. patent discussed in Prior Art whose rounded convex tip only encompasses considerably less of the Button.

Having only the Combination Pole Point, the user would not have to change Pole Points for the three Different Device Situations, especially when in a large two-story house with many Devices on either the ceiling or wall location. The Screw Combination Pole Point has the Combination advantages for the particular kind of Pole of Another with the wooden (or similar material) distal end.

Could add a Push/Pull Pole Point to both push or pull on the various toggles and switches on a remote Device of that type.

Could add a Pull Pole Point to pull on a light bulb chain or similar.

Could add a Fan Pole Point to be used to dissipate the smoke, gas or heat from within and around a smoke, gas (often CO) or heat Detector.

Could add more Other-Pole Points based on different types and dimensions of the distal ends of the Poles of Another kind. The Push/Pull, Pull, and Fan Pole Points can also be Other-Pole Points for attachment to the Poles of Another kind.

There are six considered Accessories to the Third Embodiment to be added to the sales packets of both the Pole with its Pole Points and the Other Pole Points to resolve certain operational problems thereof: a ?-shaped "cup holder" screw to hang the Pole from its Looped end in a convenient location; ear plugs to dampen the 85 dbl beeping of the Devices; thick dark-colored adhesive paper cutouts to adhere to Buttons to increase their visibility if needed; a simplified moveable reminder calendar of Testing dates; the Rubber Cap to be added to the Cone and Tip of the Straight and Angled Pole Points to increase friction at the Button; and a small looped pull-string bag to hold regularly used Points, ear plugs, Rubber Cap, and reminder calendar to hang with the Pole. The additional costs of any or all of these will be weighed against their benefits and the cost of any competitor's product.

CONCLUSIONS

Overall Considerations: The Big Picture

Generally, the Actuation Items are superior over the five Prior Art. Refer to the explanations of the Background and Advantages sections for the specific advantages.

Generally, the ease and effectiveness in the use of the Actuation Items include features of: hand comfort; unobstructed and increased visibility; use of unique black Schedule 80 PVC ½ Piping and the same Polyvinyl Chloride plastic for casting the Points; the resulting ease of making and relative low cost; interchangeable Points; easy screw-on and off attachment; minute point of contact; Loop for hanging convenience; the three Pole lengths or the Other-Pole Points on the Pole of Another kind of sufficient length; avoidance of fall and injury with possible feelings of safety, security and confidence for both the user and the other members of the household.

The use of the Actuation Items also in the other types of residential units and in the non-residential school, hospital, office, commercial and industrial buildings.

The market potential: up to 10 Devices in a large house with possibly a Pole at each location for emergency convenience; in 2014 93% of the U.S.'s 134 million housing units had the Devices, 80% in UK, and then the rest of the world; only one commercial available product for the Actuation Purpose was found, so the Pole and both types of Points are novel; the relative low cost of making; and there are two sales packages of the Pole with Pole Points and Screw Combination Pole Point, and four sales package groups for the Other-Pole Points.

The four Embodiments: the First is eliminated along with claim 1, error about infringement; the generalized Second is an overview without details; the Fourth has descriptions only of design alternatives; and finally, the Third with all the details about the four Actuation Items, pictured in the drawings. with reference numbers, and some additional information about related topics.

It is considered that the four Actuation Items are unique and novel from the five Prior Art, other Prior Art, and the one available commercial product. It is seriously hoped that the Four Actuation Items will pass the PTO's unobviousness test as well.

Specific Considerations: A Closer Look

The hand comfort is based on the Pole's maximum length, circular cross-section, 2.16 cm (0.85") diameter, regular smooth surface without casting ridges, neutral temperature of plastic, and hollow reduced weight.

There is unobstructed and increased visibility due to the two conical Pole Points and black color verse the light-colored Buttons and Device surfaces.

The modified hollow black Schedule 80 PVC ½ piping is used because of its availability, low cost, color, slightly thicker wall and lack of casting ridge on the surface than the grey one; the unique modification moves the V-threading inside; and The same black Polyvinyl Chloride plastic of the Points, which could use Autocad and 3D printing for the mold casting.

The Pole and the Other-Pole Point on a Pole of Another kind are for pushing or pushing and holding for a few seconds the Button on out of reach Devices, such as fire Alarms and smoke, gas (often CO) or heat Detectors.

The cost of manufacturing and the price of the sales packages should be competitive with any product for the Actuation Purpose. Moving the manufacturing and packaging to China or similar might be considered necessary eventually for a lowest sales price.

The 1.29 m (51") long Pole provides a 1.37 m (4.5') person on toes a 3.01 m (9' 10.5") reach and a 1.98 m (6.5') person on toes a 3.75 m (12.3') reach, or an Other-Pole Point on a Pole of Another kind of sufficient length should be able to reach an out of reach Device at significant heights.

The two conical-shaped Pole Points with the spherical Tip provides a well directed single minute point of contact, especially when the Button is depressed below the Device surface or when there is a raised surface adjacent to the Button, alternatively the cone's can have an enclosed rubber cylinder with an exposed distal spherical Tip, to increase the friction on the Device's button. as shown in FIG. 3.

The attachment method on the separate elements is screw-on threading which is easy and quick to achieve.

While the various descriptions in this Application contain specifics, including dimensions or similar, these should not be considered limitations on the scope of the Embodiments, but only as examples. Many other ramifications and variations are definitely possible within the defined Embodiments and in the other descriptions. Therefore, the scope should be determined by the Claims and their legal equivalents, and not limited by the examples given.

I claim:

1. An elongated hand tool for actuation of an out of reach device comprising:

a first hollow pole body having a threaded portion at a first end thereof and a second end thereof and defining a tool axis;

a plurality of pole points, each having a threaded base portion defining a point axis for removably attaching each said point to the first end of the first pole body;

wherein the plurality of pole points comprise at least five distinctly shaped point ends including a cone shaped straight point centered on said point axis, a cone shaped angled point extending approximately 60 degrees from said point axis, a truncated straight point centered on said point axis having an open circular hollow space with inwardly sloping conical walls and a partial convex sphere at an end thereof, a truncated angled point having an open circular hollow space with inwardly sloping conical walls and a partial convex sphere at an end thereof and extending approximately 60 degrees from said point axis, and a combination point comprising a cone shaped straight point of said combination point having an axis centered on said point axis, a cone shaped angled point of said combination point extending approximately 60 degrees from said point axis, and a truncated angled point of said combination point having an open circular hollow space with inwardly sloping conical walls and a partial convex sphere at an end thereof and extending approximately 60 degrees from said point axis in an opposite direction from said angled point of said combination point; and a looped cap attached to the second end of said first pole body configured to hang said hand tool.

2. The elongated hand tool as claimed in claim 1, further comprising at least two extension pole bodies connected to said first hollow pole body via a corresponding internal connector to increase the length of the hand tool.

3. The elongated hand tool as claimed in claim 1, wherein the first hollow pole body material is modified black schedule 80½ inch PVC piping to provide visual contrast, hand comfort, and strength.

4. The elongated hand tool as claimed in claim 3, wherein each of the plurality of pole points are made from a same material as said first hollow pole body.

5. The elongated hand tool for actuation purposes as claimed in claim 1, wherein said cone shaped straight points and said cone shaped angled points further include a rubber tip to provide additional contact friction.

* * * * *